United States Patent [19]

Wolfe

[11] Patent Number: 4,479,419

[45] Date of Patent: Oct. 30, 1984

[54] DUAL CAPACITY RECIPROCATING COMPRESSOR

[75] Inventor: Robert W. Wolfe, Wilkinsburg, Pa.

[73] Assignee: Westinghouse Electric Corp., Pittsburgh, Pa.

[21] Appl. No.: 438,429

[22] Filed: Nov. 2, 1982

[51] Int. Cl.[3] ..... F04B 23/06; F01B 7/04

[52] U.S. Cl. ..... 92/13.3; 417/534; 417/539; 417/429

[58] Field of Search ..... 74/571 R; 417/534, 539, 417/429, 315; 92/13.3

[56] References Cited

U.S. PATENT DOCUMENTS

| | | | |
|---|---|---|---|
| 3,010,339 | 11/1961 | Brock | 74/571 |
| 4,143,995 | 3/1979 | Diuisi | 417/315 |
| 4,236,874 | 12/1980 | Sisk | 417/315 |

*Primary Examiner*—William L. Freeh

*Attorney, Agent, or Firm*—E. C. Arenz

[57] ABSTRACT

A multi-cylinder compressor 10 particularly useful in connection with northern climate heat pumps and in which different capacities are available in accordance with reversing motor 16 rotation is provided with an eccentric cam 38 on a crank pin 34 under a fraction of the connecting rods, and arranged for rotation upon the crank pin between opposite positions 180° apart so that with cam rotation on the crank pin such that the crank throw is at its normal maximum value all pistons pump at full capacity, and with rotation of the crank shaft in the opposite direction the cam moves to a circumferential position on the crank pin such that the overall crank throw is zero. Pistons 24 whose connecting rods 30 ride on a crank pin 36 without a cam pump their normal rate with either crank rotational direction. Thus a small clearance volume is provided for any piston that moves when in either capacity mode of operation.

4 Claims, 6 Drawing Figures

DUAL CAPACITY RECIPROCATING COMPRESSOR

GOVERNMENT CONTRACT

The Government has rights in this invention pursuant to Prime Contract No. W-7405-ENG-26 and Subcontract No. 86X-24712-C awarded by the United States Department of Energy.

BACKGROUND OF THE INVENTION

This invention pertains to the art of dual capacity compressors or pumps in which the dual capacity is obtained through changing the connecting rod stroke length from one length to another through reversal of the driving motor.

While I consider that my invention is applicable to devices used in other environments, it is particularly applicable for use in compressors in domestic heat pumps especially designed for use in a northern climate where a wide range of refrigerant flow rate is required. If the heat pump is sized for the greatest heating load which occurs at low ambient temperatures, then it has too much capacity at more moderate ambient temperatures and must cycle on and off, which leads to performance penalties.

One arrangement which has been devised to avoid the problem is found in Sisk U.S. Pat. No. 4,236,874 which teaches a reciprocating compressor which employs an eccentric cam rotatably mounted on the crank pin in which the rotation of the cam on the crank pin is angularly limited. On reversal of compressor rotation, the cam shifts from one angular extremity to an opposite angular extremity and by so doing changes the vector sum of cam eccentricity and crank pin throw so as to provide two different stroke lengths. A change in displacement and clearance ratio results in two different refrigerant flow rates depending upon the direction of rotation of the motor. The cam is driven from one end point to the other by the fraction of compressor torque delivered by the cam eccentricity.

Experimental use of the noted arrangement has shown that it operates substantially in the manner intended, but has also shown that the operation of the compressor in the reduced capacity mode has certain deficiencies. In particular, as the pressure ratio across the compressor increases (due to a decrease in the temperature of the medium from which the heat pump is drawing heat), the flow rate which the compressor delivers drops in accordance with the amount of stroke reduction designed into the eccentric cam. This condition is caused by the larger clearance volume resulting from a shortened stroke. The larger the clearance volume, the smaller the pressure ratio the piston can produce. Because the friction and other losses in the compressor are not decreasing at a comparable rate, the compression efficiency of the compressor decreases rapidly along with the flow rate.

The aim of my invention is to provide an arrangement in which this loss of efficiency during operation in the reduced capacity mode is lessened.

SUMMARY OF THE INVENTION

In accordance with my invention, I provide a compressor with at least two reciprocating pistons and provide the eccentric cam on the crank pin means for less than the total number of pistons, with the cam having eccentricity equal to the crank pin throw of the crank pin means upon which it is rotatably mounted, and provide means limiting the rotation of the cam between opposite positions of about 180° apart, in accordance with the direction of crank shaft rotation, with the cam in one position adding to the eccentricity of the throw of the crank pin means upon which it is mounted, and in the other position subtracting the eccentricity from the throw so that in the reduced capacity mode of operation of the compressor any piston having a stroke length depending upon the position of the eccentric cam will have a zero stroke length.

As stated in terms of the functioning of the device, one or more pistons will operate in all modes with a full stroke length, while any piston associated with an eccentric cam will operate at either a full stroke length or no stroke length.

DESCRIPTION OF THE PREFERRED EMBODIMENT

The invention is considered applicable to compressors and pumps other than those used in the refrigeration art, but the invention will be explained in that connection.

The description will proceed in connection with a prior art structure disclosed in the noted patent to provide an explanation of one environment in which the invention may be applied, and also to provide an explanation of the problems experienced with the prior art structure. Reference should be had to the noted patent for details not considered necessary herein.

Figure 1:
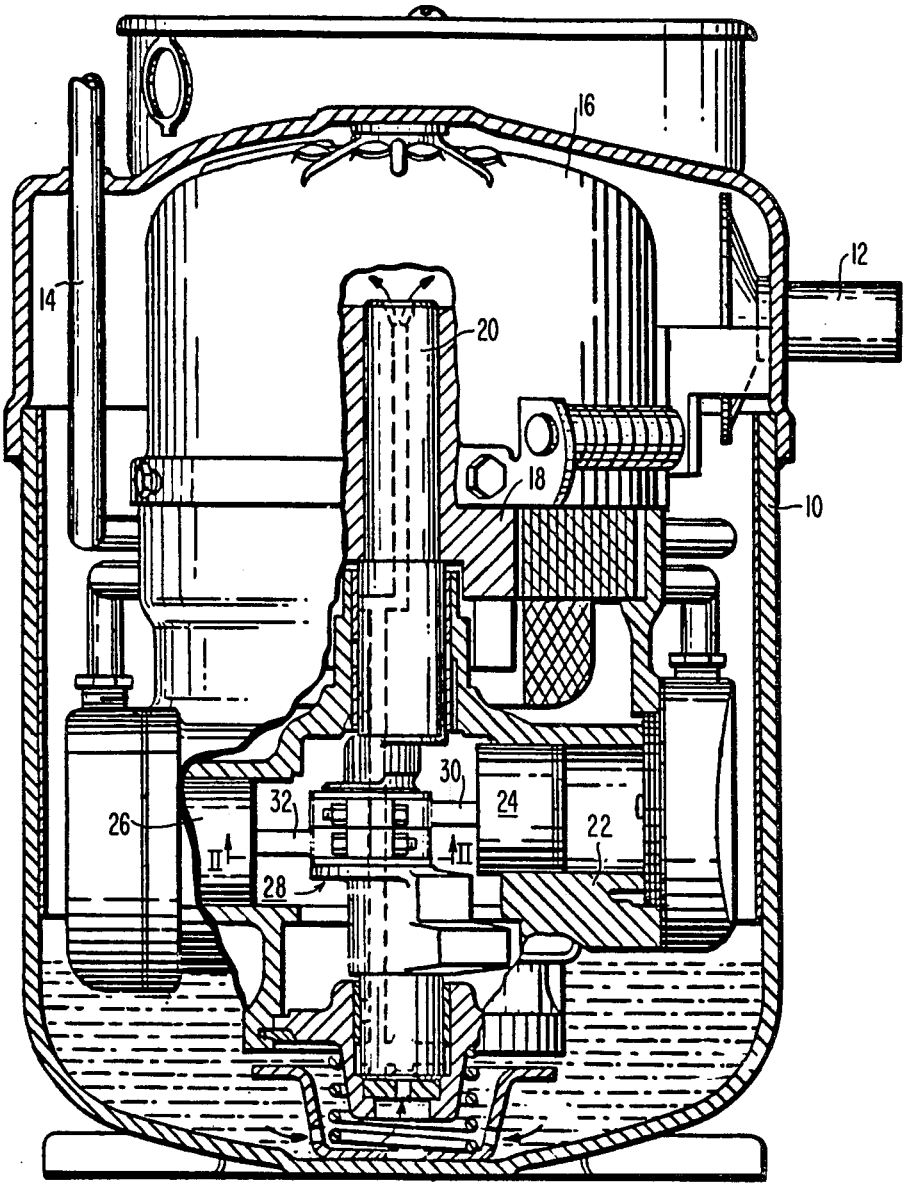
FIG. 1 PRIOR ART
FIG. 1 is a side view of a hermetic refrigerant compressor representative of one type to which the invention may be applied, with the shell shown in cross section and certain parts being broken, this figure being a prior art figure taken from the noted patent.

Referring to FIG. 1, a generally cylindrical hermetically sealed shell 10 has an inlet 12 through which the suction gas refrigerant is admitted to the shell, and one or more discharge gas tubes 14 through which the compressed gas exits from the shell. The upper part of the shell houses a reversible electric motor 16 whose rotor is fixed to the upper end of the crank shaft 20 to rotate the crank shaft in one direction or the other depending upon the direction of rotation of the rotor.

In the illustrated unit, the compressor has two cylinders 22 in one of which piston 24 reciprocates and in the other of which the piston 26 reciprocates. These two pistons are connected to the crank pin means area generally designated 28 by one connecting rod 30 and another connecting rod 32. The crank pin means area, which is a principal concern of my invention, is obscured in FIG. 1 by the strap ends of the connecting rods.

Figure 2:
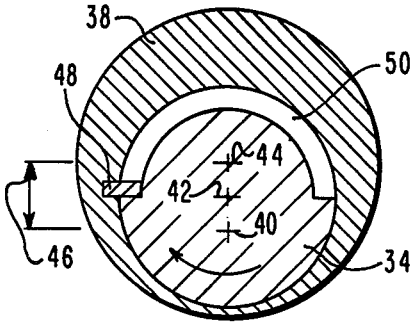
FIG. 2 is a diagrammatic cross-sectional view of a crank pin and eccentric cam according to my invention, this view showing the cam in a position for full stroke operation.
Figure 3:
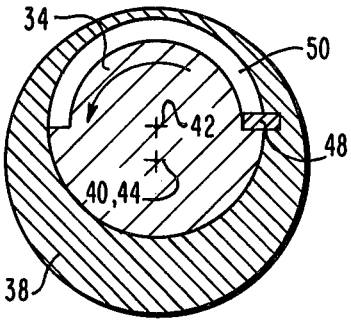
FIG. 3 is a view similar to FIG. 2 with the cam in the opposite position to give zero stroke operation.
Figure 4:
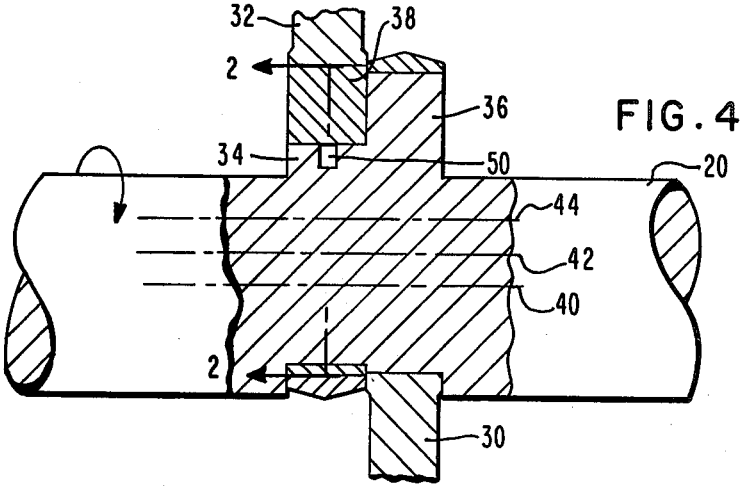
FIG. 4 is a partly diagrammatic view, mostly in longitudinal cross-section, of a two piston compressor with the arrangement according to the invention, and with the cam in the full stroke position as in FIG. 2.
Figure 5:
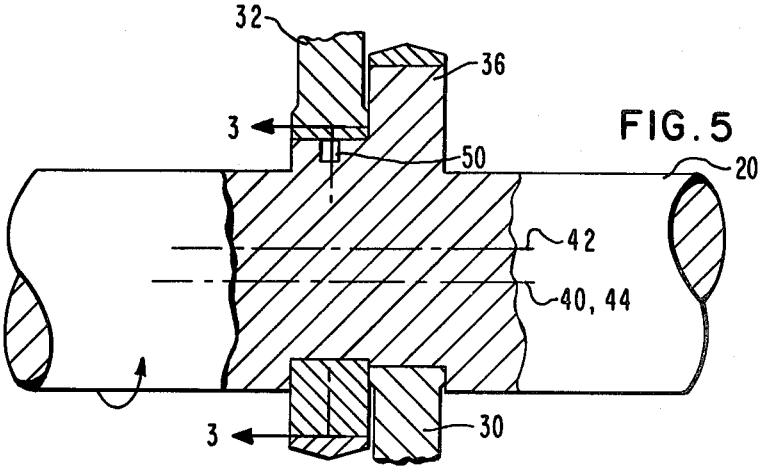
FIG. 5 is a view similar to FIG. 4 with the cam in the FIG. 3 position for zero stroke operation of the one piston.

Referring now to FIGS. 2–5, FIG. 2 may be considered to correspond to a section taken along the line 2—2 of FIG. 4, and FIG. 3 corresponds to a section taken along the line 3—3 of FIG. 5. The crank shaft 20 has one crank pin means 34 which has one crank throw, and another adjacent crank pin means 36 on the same shaft which has a greater crank throw. The eccentric cam means 38 is rotatably mounted on the crank pin means 34, and this eccentric cam has a degree of eccentricity equal to the crank throw of the crank pin means 34. The longitudinal center lines of the crank shaft, crank pin and the eccentric cam are indicated by the numerals 40, 42 and 44, respectively. The total throw of the crank pin and the eccentric with the parts in the relationship shown in FIG. 2 is equal to the dimension indicated by the arrow 46 to the left of FIG. 2. The crank throw of the crank pin means 34 itself is equal to half this value and would be equal to the distance between the crank shaft center and the crank pin means 34 center.

With the crank shaft rotating in the direction indicated by the arrow, the eccentric remains in its illustrated rotative position upon the crank pin means 34 by virtue of the pin or key 48 affixed to the cam 38 and projecting into the circumferential recess 50 formed as a groove through 180° in the crank pin means 34. The key and the ends of the recess constitute the means limiting the rotation of the cam relative to the crank pin since in FIG. 2 the rotation of the crank pin in the indicated direction forces the end of the recess against the pin, while in FIG. 3, with the cam rotatably repositioned upon the crank pin means 34, the opposite end of the recess will bear against the key 48. The repositioning from one position to an opposite position takes place automatically upon reversal of motor direction due to the frictional forces between the crank pin strap and the cam.

It will be apparent that with the cam positioned relative to the crank pin as shown in FIG. 2, a full stroke of the piston 26 is obtained in accordance with the dimensions of the cam and crank pin means. Conversely, in the FIG. 3 position, the cam 38 has rotated to a position upon the crank pin means 34 in which the eccentricity of the cam is subtracted from the throw of the crank pin means 34 so that the longitudinal center lines of the crank shaft and of the cam exterior coincide at the location 40, 44. Thus as the crank shaft turns in the direction indicated in FIG. 3, the piston 26 has zero stroke and whatever losses are associated with a stroke dimension are avoided.

The other crank pin means 36 (FIGS. 4 and 5) is provided with a crank throw which is greater than the crank throw of the one crank pin means 34 and provides a full stroke to its piston 24 irrespective of the direction of motor rotation. Thus, regardless of whether the eccentric cam 38 is in either of its positions of FIGS. 4 and 5, the full stroke and relatively high efficiency, because of small clearance volume, is available to the connecting rod 30 and its piston.

Figure 6:
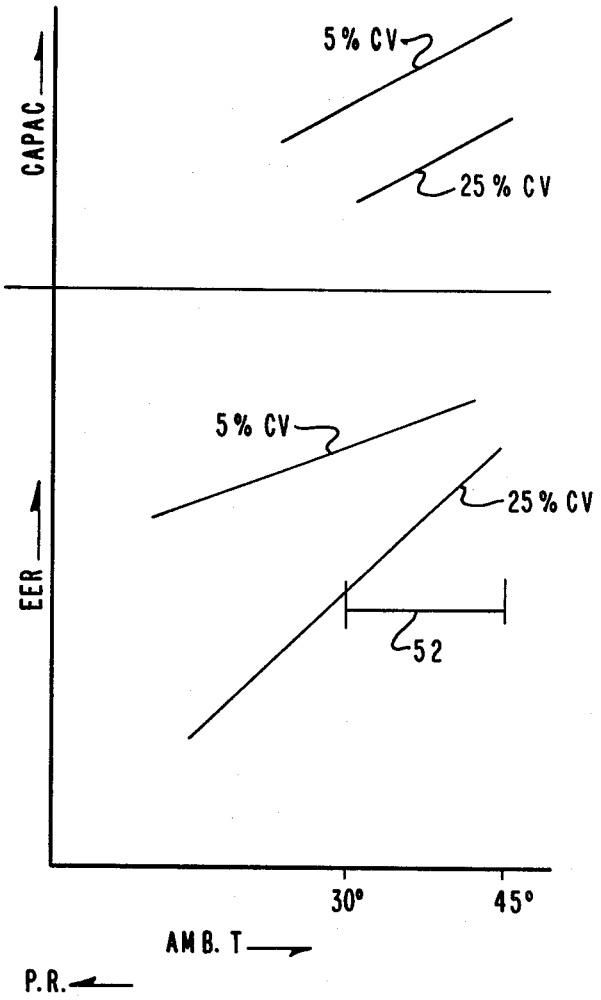
FIG. 6 is a graph showing the effects upon capacity and energy efficiency ratios when pressure ratios change in accordance with ambient temperature changes, for pistons with two different clearance volumes.

The advantage to be obtained with my arrangement, as contrasted to an arrangement in which all of the pistons can have a full stroke or a reduced stroke (but greater than zero), will perhaps be better appreciated from the information in FIG. 6. The 5 percent CV (clearance volume) curves in both the upper and lower portions of the graph indicate in a general way the changes in capacity and in EER (energy efficiency ratio) as the ambient temperature decreases and the pressure ratio (PR) increases, each of these curves being based upon some given condenser temperature. The 5 percent CV generally corresponds to a piston having a full stroke as with the cam 38 in the full stroke FIGS. 2 and 4 positions, and as with the other piston driven by crank pin means 36 irrespective of the positioning of the cam 38. The 25 percent CV curves show changes in capacity and EER, also with different ambient temperatures. The 25 percent CV corresponds to a reduced stroke mode of operation as disclosed in the noted Sisk patent. It will be seen that with respect to both capacity and with respect to EER, the 25 percent curves are in a lowered position with respect to a full stroke curve, and in the case of the EER ordinate, the slope of the 25 percent curve is significantly greater so that as the ambient temperature reduces and the pressure ratio increases, the disadvantage of the reduced stroke piston increases.

With a northern climate type of heat pump to which this invention is considered particularly applicable, there are frequently days in which the ambient temperature calls for heating but is not severe enough to call for full stroke of all pistons. Such ambient temperatures might be between, for example, 30° to 45° F. (−1° to 7° C.) as indicated on the abscissa of the graph. Below a temperature in the neighborhood of 30° F., the device would typically go to full stroke heating. The line 52 on the graph indicates such a temperature range and it will be seen that if a reduced stroke device is used therein, which would frequently be a considerable portion of the operating time in the heating mode, the capacity and EER are penalized to the extent of the vertical distance between the 5 percent and the 25 percent CV curves. Thus, with the arrangement according to my invention, any operation is at full stroke so that the disadvantages of reduced clearance volume are avoided in all cases.

The description has proceeded in connection with a two piston compressor for purposes of the example. It will be apparent that the invention is applicable to compressors having two or more cylinders. Thus, with a three cylinder compressor, the arrangement would normally be to extend the reduced crank pin 34 and cam means 38 to accommodate two pistons for either full stoke or zero stroke and a single piston would be driven in the full stroke at all times. With a four piston compressor, two pistons would normally be always full stroke, while with a five piston machine, normally two would be always full stroke.

Also, while the description has proceeded in connection with a radial type of compressor, the invention is considered to be equally applicable to the so-called aligned arrangements in which each adjacent crank pin means is separate and has off-set longitudinal center lines.

Because the length of stroke change with my arrangement is greater than that where only a reduced stroke is provided, the problems of imbalance because of the greater eccentricity may be potentially more severe with my arrangement. However, this may be accommodated by lightening parts of the cam, such as by drilling strategically located holes, and/or using different density materials for different parts of the cam.

What is claimed is:

1. In a compressor including at least two reciprocating pistons, the improvement comprising:

a crank shaft with separate crank pin means for each piston, at least one crank pin means having one crank throw and at least another crank pin means having a greater crank throw;

eccentric cam means rotatably mounted on said one crank pin means, said eccentric cam means having an eccentricity equal to said one crank throw;

one connecting rod connecting said cam means to one piston, and another connecting rod connecting said one crank pin means to another piston;

means limiting rotation of said cam on said one crank pin means to opposite positions of about 180° apart, and in accordance with direction of crank shaft rotation, said cam in one position adding the eccentricity to the throw of said one crank pin means, and said cam in the other position subtracting the eccentricity from the throw of said one crank pin means so that with said cam in said other position said one piston has a zero stroke length.

2. A compressor according to claim 1 wherein:

said compressor includes at least three reciprocating pistons; and said eccentric cam means is associated with the crank pin means for at least half, but less than all of the pistons.

3. A compressor according to claim 1 wherein:

said one crank throw plus the eccentricity of said cam is equal to said greater crank throw.

4. In the method of changing the capacity of a multiple cylinder refrigerant compressor by reversing the direction of rotation of the motor driving the compressor to change the overall throw of crank means comprising eccentric cam means on crank pin means for less than all pistons of the compressor:

operating said motor in one direction to automatically rotatively position said cam means in one position to add the eccentricity of said cam means to said crank pin means to give equal, full stroke lengths with one crank throw for all pistons of the compressor;

operating said motor in the opposite direction to automatically rotatively position said cam means about 180° from said one position to an opposite position to subtract the eccentricity of said cam means to give zero stroke length for those pistons driven from crank pin means provided with said eccentric cam means.

* * * * *